US006877801B2

(12) United States Patent
Asbach et al.

(10) Patent No.: US 6,877,801 B2
(45) Date of Patent: Apr. 12, 2005

(54) ADJUSTABLE CHILD SUPPORT STRUCTURE WITH ACCESSORIES

(75) Inventors: Ronald M. Asbach, Grand Island, NY (US); Michael T. Kane, Conesus, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/969,611

(22) Filed: Oct. 4, 2001

(65) Prior Publication Data

US 2003/0067193 A1 Apr. 10, 2003

(51) Int. Cl.[7] ..... A47D 1/02

(52) U.S. Cl. ..... 297/16.1; 297/153; 297/188.01; 297/188.2

(58) Field of Search ..... 297/16.1, 153, 297/281, 188.01, 188.2; 224/161; 472/118, 119, 125; 248/121, 167, 170, 222.13, 224.8, 311.2

(56) References Cited

U.S. PATENT DOCUMENTS

| | | | | |
|---|---|---|---|---|
| 389,834 A | * | 9/1888 | Caldwell | 5/109 |
| 1,147,191 A | | 7/1915 | Rundle | |
| 1,232,690 A | | 7/1917 | Keenan | |
| 2,672,182 A | | 3/1954 | Gwin et al. | |
| 2,724,429 A | | 11/1955 | Warner | |
| 2,726,838 A | | 12/1955 | Ripley, Jr. | |
| 2,731,072 A | | 1/1956 | Post | |
| 2,762,161 A | | 9/1956 | Danielson | |
| 2,935,122 A | | 5/1960 | Miller | |
| 2,971,570 A | | 2/1961 | Vander Bush | |
| 3,143,374 A | | 8/1964 | Carboni | |
| 3,425,744 A | | 2/1969 | Spector et al. | |
| 3,475,052 A | | 10/1969 | Kaposi | |
| 3,542,419 A | | 11/1970 | Spinola | |
| 3,649,074 A | | 3/1972 | McDonald et al. | |
| D229,999 S | | 1/1974 | Blazey et al. | |
| 3,909,061 A | | 9/1975 | Johnson | |
| 4,065,177 A | | 12/1977 | Hyde et al. | |
| 4,094,547 A | | 6/1978 | Zampino et al. | |
| 4,193,630 A | | 3/1980 | Steele | |
| 4,239,259 A | | 12/1980 | Martinez | |
| 4,376,502 A | * | 3/1983 | Cohen | 224/411 |
| 4,491,317 A | * | 1/1985 | Bansal | 472/119 |
| 4,603,902 A | | 8/1986 | Maloney | |
| 4,616,795 A | | 10/1986 | Bender | |
| 4,722,570 A | | 2/1988 | Bertoli | |
| D298,598 S | | 11/1988 | Ellman et al. | |
| 4,799,638 A | * | 1/1989 | Allen | 248/311.2 |
| 4,807,872 A | * | 2/1989 | Spilman et al. | 472/119 |
| 4,830,200 A | | 5/1989 | Zambano et al. | |
| 4,844,537 A | | 7/1989 | Reed | |
| 4,917,396 A | * | 4/1990 | Meneses et al. | 224/450 |
| 4,938,603 A | | 7/1990 | Turner et al. | |

(Continued)

FOREIGN PATENT DOCUMENTS

GB 2240711 A 8/1991

OTHER PUBLICATIONS

Cosco Instruction manual for "Flair Chair," 2 pages in English, 2 pages in French; References U.S. Appl. No. 4,653,805.

"Living Well . . . Spending Less" catalog, front cover and 1 page under "Infant and Youth Furnishings, Strollers, Car Seats and Play Yards" section.

*Primary Examiner*—Peter R. Brown
(74) *Attorney, Agent, or Firm*—Cooley Godward LLP

(57) ABSTRACT

A child support structure includes a locking mechanism that can be selectively moved to place the child support structure in either of a deployed position and a collapsed position and a carriage assembly that enables a seat portion to be positioned at different heights. The child support structure includes a frame and a container removably coupled to the frame. The container holds articles on the support structure and can be used during the washing the articles in a dishwasher.

17 Claims, 17 Drawing Sheets

U.S. PATENT DOCUMENTS 5,040,709 A * 8/1991 Neugent ..... 224/414
5,071,149 A 12/1991 Perego
5,104,180 A 4/1992 Takahashi et al.
5,113,537 A * 5/1992 Turk ..... 5/121
5,165,755 A 11/1992 Rho
5,201,535 A 4/1993 Kato et al.
5,238,292 A 8/1993 Golenz et al.
5,244,175 A 9/1993 Frankel
D344,189 S 2/1994 Golenz et al.
5,314,232 A 5/1994 Hopkins
5,348,374 A 9/1994 Kuo
5,364,137 A 11/1994 Shimer
D358,730 S 5/1995 Meeker et al.
5,445,432 A 8/1995 Chien
5,460,102 A 10/1995 Pasmanick
5,464,183 A 11/1995 McConnell et al.
5,468,043 A 11/1995 Chien
5,468,051 A 11/1995 Huang
5,489,138 A 2/1996 Mariol et al.
5,507,550 A 4/1996 Maloney
5,509,719 A 4/1996 Cone, II
5,520,433 A 5/1996 Tokutake et al.
5,558,391 A 9/1996 Chavous
5,558,400 A 9/1996 Poulson et al.
5,586,800 A 12/1996 Triplett
5,615,925 A 4/1997 Kain
5,624,156 A 4/1997 Leal et al.
5,660,432 A 8/1997 Davis
D383,338 S 9/1997 Gibbs
5,662,378 A 9/1997 Carruth
5,676,424 A 10/1997 Winkelhake
5,699,564 A 12/1997 Heh
5,707,104 A 1/1998 Perego
5,727,842 A 3/1998 O'Neil
5,810,432 A 9/1998 Haut et al.
5,820,207 A 10/1998 Wang
5,823,615 A 10/1998 Haut
5,829,826 A 11/1998 Ziccardi
5,833,189 A 11/1998 Rossman et al.
5,857,601 A 1/1999 Greenwood
5,951,102 A 9/1999 Poulson et al.
5,967,345 A 10/1999 Subotin
5,975,628 A 11/1999 Russell
5,992,932 A 11/1999 Kain et al.
6,001,021 A * 12/1999 Battaglia ..... 297/281
6,048,023 A 4/2000 Lampton
6,050,643 A 4/2000 Kain et al.
6,068,285 A 5/2000 Jackson et al.
6,089,653 A 7/2000 Hotaling et al.
6,089,666 A 7/2000 Rosko
6,113,454 A 9/2000 Mitchell
6,119,996 A 9/2000 Connery
6,120,092 A 9/2000 Asad
6,126,236 A 10/2000 Wu
6,129,414 A 10/2000 Brevi
6,131,925 A 10/2000 Weldon
6,161,898 A 12/2000 Brevi
6,216,605 B1 4/2001 Chapman
6,277,028 B1 * 8/2001 Liu ..... 472/118
6,401,996 B1 * 6/2002 Thom et al. ..... 224/407
6,484,989 B1 * 11/2002 Connery ..... 248/311.2
6,511,123 B1 * 1/2003 Sitarski et al. ..... 297/130
6,561,915 B2 * 5/2003 Kelly et al. ..... 472/119

* cited by examiner

ADJUSTABLE CHILD SUPPORT STRUCTURE WITH ACCESSORIES

BACKGROUND

1. Field of the Invention

The present invention relates generally to a child support structure, and more particularly, to a foldable and adjustable high chair.

2. Discussion of the Related Art

Conventional child support structures, such as high chairs, include folding mechanisms that allow the high chairs to be folded from a deployed position to a collapsed position and opened from a collapsed position to a deployed position. Such conventional support structures include height adjustment mechanisms that allow the high chair seats to be positioned at different predetermined heights. Those conventional mechanisms have been generally difficult to adjust due to cumbersome and complex designs.

High chairs are generally used by parents or care givers to feed an infant or child. During such feedings, many types of utensils and dishes, such as cups, spoons, and other materials, are needed. These materials are normally scattered in various places around the high chair, thereby resulting in the feeding being difficult and messy. To overcome these problems, conventional high chairs have been provided with pouches or other containers that are attached to the back of the high chair seat or to the high chair tray.

Many conventional containers are cumbersome to attach to the high chair. Often the containers obstruct the collapsing and opening of the high chair and block other adjustment mechanisms that are disposed on the high chair. A need exists for a simple mechanism that can be used to secure the high chair in a deployed position. A need exists for a mechanism that allows the high chair seat to be positioned at different predetermined heights. A need also exists for a removable container that retains articles used during the feeding of a child in a high chair and that can easily store the articles to enable the container and articles to be cleaned, such as in a dishwasher.

SUMMARY OF THE INVENTION

The child support structure of the present invention solves the problems with, and overcomes the disadvantages of, conventional child support structures. In particular, the child support structure includes a latch or locking mechanism that can be selectively moved to enable the child support structure to be disposed in a deployed or open position and a collapsed or storage position. In one embodiment, the child support structure includes an adjustment mechanism that allows a high chair to be easily positioned at different heights. In another embodiment, the child support structure includes a removable container that can contain articles to be used during the feeding or entertainment of a child in a high chair and that can easily store the articles to enable the container and articles to be easily cleaned.

DETAILED DESCRIPTION

A child support structure includes a frame having a first frame member and a second frame member. A support portion is coupled to the frame and a housing is coupled to an upper end of the first frame member and an upper end of the second frame member. The first frame member is rotatably coupled to the housing and includes an engagement portion. A locking or latch mechanism is coupled to the housing. The locking mechanism includes a body portion having a first end and a second end. The first end of the body portion is rotatably coupled to the housing and the second end is releasably engageable with the engagement portion of the first frame member. The first frame member is selectively movable relative to the second frame member between a collapsed or storage position and a deployed or open position.

In one embodiment, a container is releasably coupleable to a child support structure that includes a frame assembly and a housing coupled to the frame assembly. The container includes a bottom portion, a top portion, and a side portion, each of which includes at least one opening. In one embodiment, a mounting aperture is formed in the side portion. The mounting aperture is configured to receive a coupler disposed on the housing to releasably couple the container to the housing. The container can hold several articles and enables the articles and the container to be easily cleaned, such as in a dishwasher.

In another embodiment, a child support structure includes a frame and a carriage assembly that is coupled to a high chair seat and a pair of legs of the frame. The carriage assembly is slidably mounted for upward and downward movement along the legs of the frame so that the high chair seat can be positioned at a number of different heights.

Figure 1:
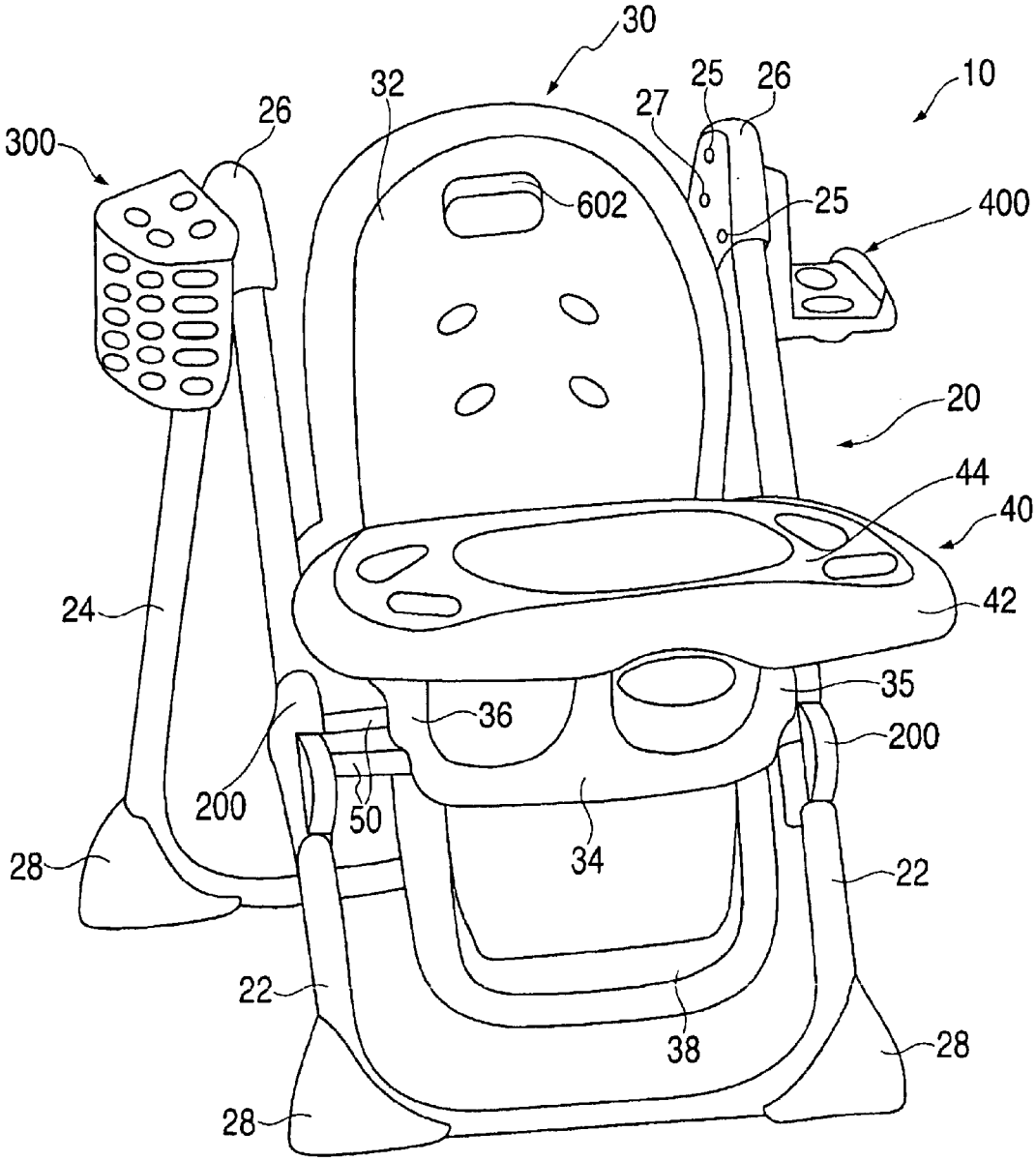
FIG. 1 is a perspective view of an embodiment of a child support structure with a frame in a deployed or open configuration according to the principles of the invention.
Figure 2:
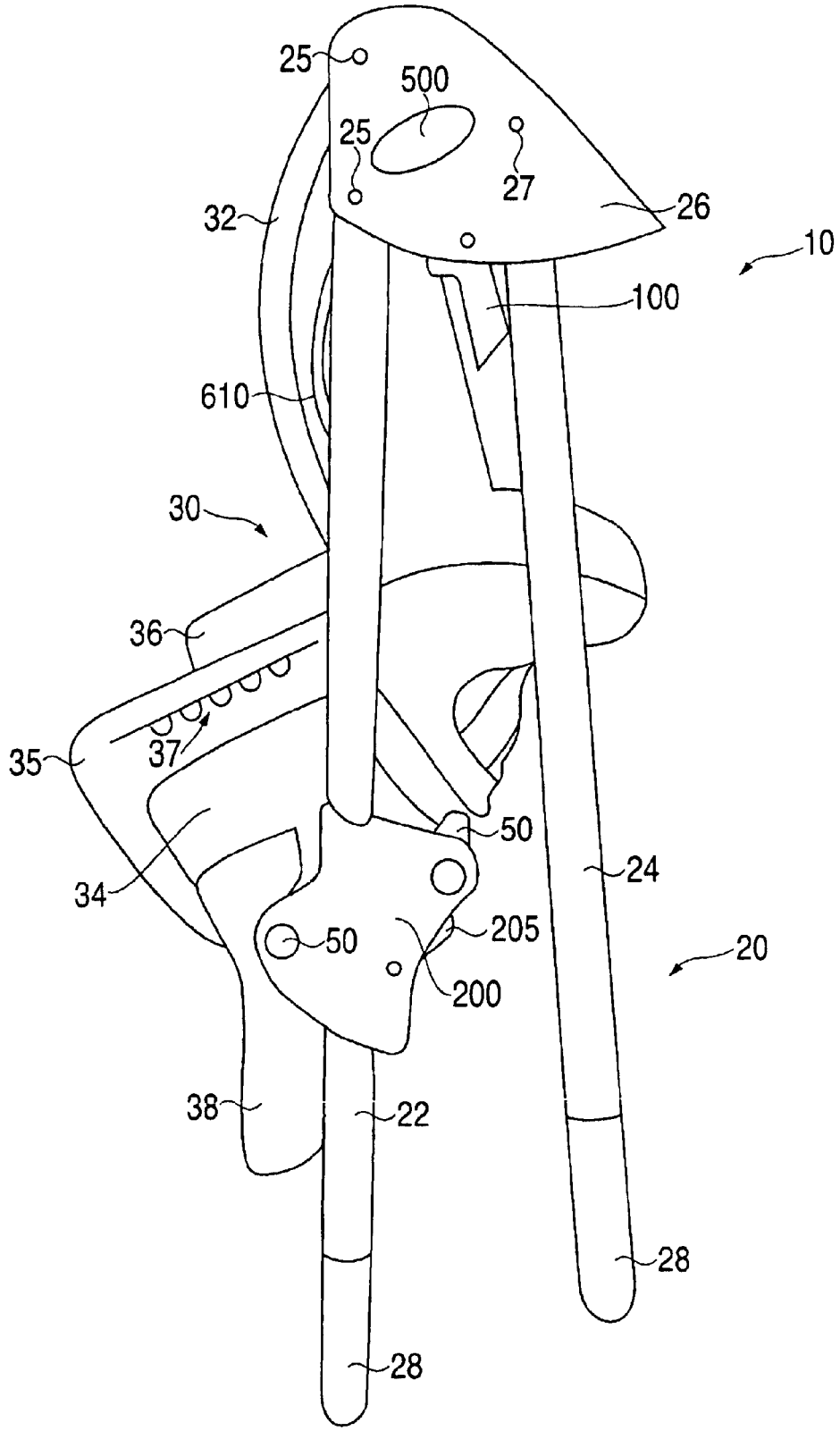
FIG. 2 is a side view of the child support structure of FIG. 1 with the frame in a generally collapsed position.

A child support structure according to an embodiment of the invention is illustrated in FIGS. 1 and 2. In the illustrated embodiment, the child support structure 10 is a high chair for an infant or child. In alternative embodiments, the child support structure may be any other structure that can support a child, such as a swing, stroller, etc. Since the illustrated child support structure 10 is generally symmetrical, where appropriate, only one side of the support structure 10 is described in detail below for simplicity.

Support structure 10 includes a frame 20 and a seat portion 30 coupled to the frame 20. Seat portion 30 includes a seat back 32 and a seat bottom 34 formed with arm portions 35 and 36. A foot rest 38 is coupled to the seat bottom 34 so that foot rest 38 receives the feet of an infant placed in seat portion 30.

Frame 20 includes a front leg 22 and a rear leg 24. On each side of the frame 20, the corresponding upper ends of the front and rear legs 22 and 24 are connected to a connector or housing 26. In order to stabilize the seat portion 30 and the frame 20, a pair of side feet 28 are provided on each of the front and rear legs 22 and 24.

In an alternative embodiment, the frame 20 may include a base portion and a substantially vertical portion extending upwardly from the base portion and connected to a housing. The base portion may have any configuration that provides support for the substantially vertical portion. For example, the frame may be configured in the shape of an inverted "T" or an inverted "Y".

In the illustrated embodiment, front leg 22 is coupled to housing 26 using any suitable attachment mechanisms 25, such as screws or other fastener. Similarly, the rear leg 24 is pivotally attached to housing 26 using any suitable attachment mechanism 27, such as a screw or fastener. In an alternative embodiment, front leg 22 can be pivotally attached to housing 26 and rear leg 24 can be fixedly coupled to housing 26.

The rear leg 24 is pivotable between a deployed or open position, as shown in FIG. 1, and a collapsed or storage position, as shown in FIG. 2. In the deployed position, rear leg 24 is angularly disposed relative to front leg 22. In the collapsed position, rear leg 24 is generally parallel to front leg 22. As described in more detail below, in order to selectively secure the rear leg 24 in its deployed position, a latch or locking mechanism 100 (FIGS. 2–6) is rotatably coupled to housing 26 and releasably engageable with rear leg 24.

As illustrated in FIG. 1, the support structure 10 includes a tray set or combination 40. The tray set 40 includes a base tray or support 42 and a removable tray 44. The removable tray 44 may also be referred to as a tray insert or liner. The tray set 40 is disclosed and discussed more fully in U.S. patent application Ser. No. 09/954,448, entitled "Removable Tray Insert and Tray Set," filed on Sep. 18, 2001 and referred to as Attorney Docket No. FSHR-035/00US, the disclosure of which is incorporated herein by reference in its entirety. Tray set 40 can be releasably attached to and slidably positioned on seat portion 30. Tray set 40 can be releasably engaged with engagement portions 37 on arm portions 35 and 36.

In the illustrated embodiment, frame 20 includes a carriage assembly 200 that is slidably attached to front leg 22. Carriage assembly 200 enables the height of seat portion 30 to be adjusted relative to a table or other object. The seat portion 30 is connected to mounting rods 50 that are coupled to the carriage assemblies 200 on the legs 22.

In the illustrated embodiment, the child support structure 10 includes a basket or container 300 and a support or container 400 for storing and holding articles, such as toys, utensils, etc. The containers 300 and 400 are releasably coupled to the housings 26 of the child support structure 10.

Figure 3:
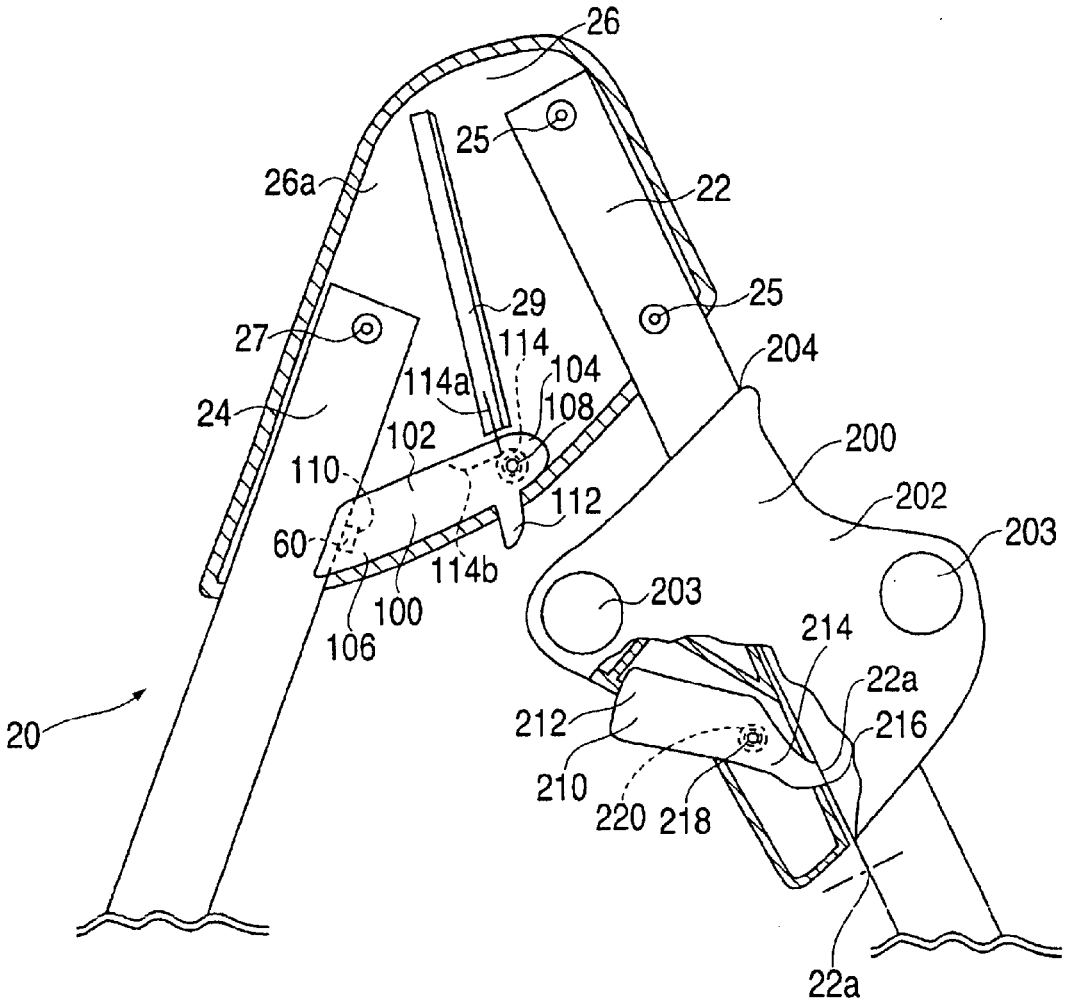
FIG. 3 is a partial sectional side view of an embodiment of a latch mechanism and carriage assembly according to an embodiment of the invention illustrating the latch mechanism and carriage assembly in an engaged position.
Figure 4:
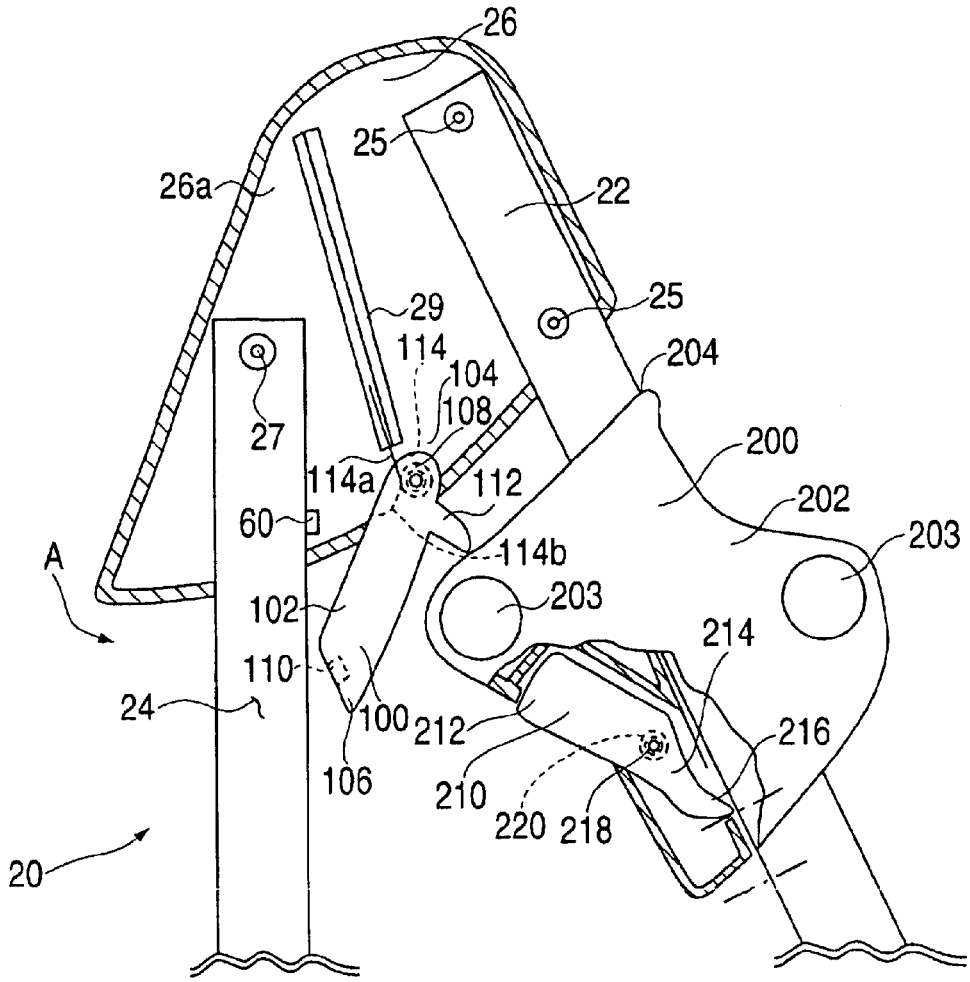
FIG. 4 is a partial sectional side view of the embodiment of the latch mechanism and carriage assembly of FIG. 3 illustrating the latch mechanism and carriage assembly in a disengaged position.

An embodiment of a latch or locking mechanism according to the invention is illustrated in FIGS. 3–6. The locking mechanism is moveable between an operative position, as illustrated in FIG. 3, and an unlocking position, as illustrated in FIG. 4.

Figure 6:
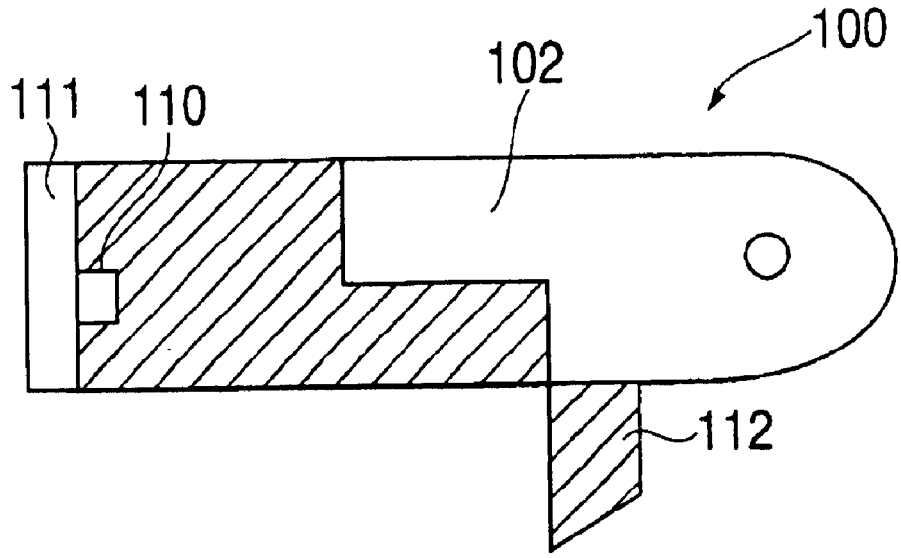
FIG. 6 is a cross-sectional side view of the latch mechanism of FIG. 5 taken along lines "6—6" in FIG. 5.
Figure 5:
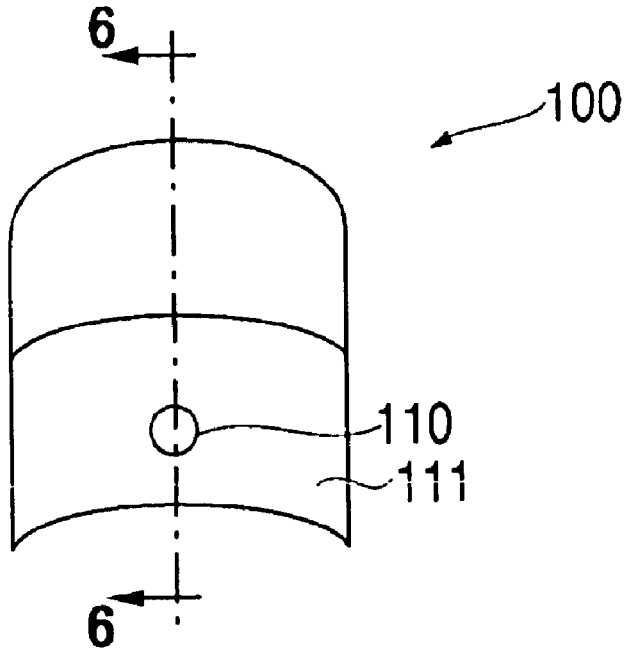
FIG. 5 is a perspective view of an embodiment of the latch mechanism according to the invention.

As illustrated in FIG. 3, housing 26 includes an internal cavity 26*a*, In the illustrated embodiment, locking mechanism 100 includes a body portion 102 having a first end 104 and a second end 106. As illustrated, first end 104 is rotatably coupled within the cavity 26*a* of housing 26 using any conventional fastener 108, such as a screw or rivet. Second end 106 includes a recess or cavity 110 formed therein, as illustrated in FIGS. 5 and 6. Second end 106 includes a contoured surface 111 shaped to engage the outer surface of rear leg 24.

In the illustrated embodiment, rear leg 24 includes an engagement mechanism 60, which can be a protrusion, tab, or other extension. Extrusion 60 is formed integrally with the rear leg 24. Alternatively, the protrusion 60 can be coupled to the rear leg 24 via conventional fastener. Recess 110 is configured to releasably receive the protrusion 60.

In an alternative embodiment, recess 110 is formed in rear leg 24 and protrusion 60 is formed on the body portion 102 of locking mechanism 100. In another embodiment, latch mechanism 100 is mounted within housing 26 such that it engages front leg 22 instead of rear leg 24 in the manner described above.

As illustrated in FIG. 4, body portion 102 includes an extension or finger 112 disposed between first end 104 and second end 106. Extension 112 is configured to enable a user to engage extension 112 and rotate the latch 100 relative to housing 26. A biasing mechanism 114 is coupled to latch 100 and disposed about fastener 108. Biasing mechanism 114 includes a first end 114*a* which engages a rib 29 in the housing cavity 26*a* and a second end 114*b* which engages body portion 102. Biasing mechanism 114 draws the body portion 102 inwardly into cavity 26*a* and into engagement with rear leg 24.

In order to move the frame 20 from the deployed position illustrated in FIG. 1, to the collapsed position illustrated in FIG. 2, the user engages extension 112 and rotates latch 100 downwardly along the direction of arrow "A" and out of engagement with leg 24. As latch 100 rotates, the protrusion 60 and the recess 110 separate. When latch 100 disengages from rear leg 24, the rear leg 24 can pivot toward front leg 22 into its collapsed position in which rear leg 24 and front leg 22 are generally parallel as illustrated in FIG. 2.

Figure 7:
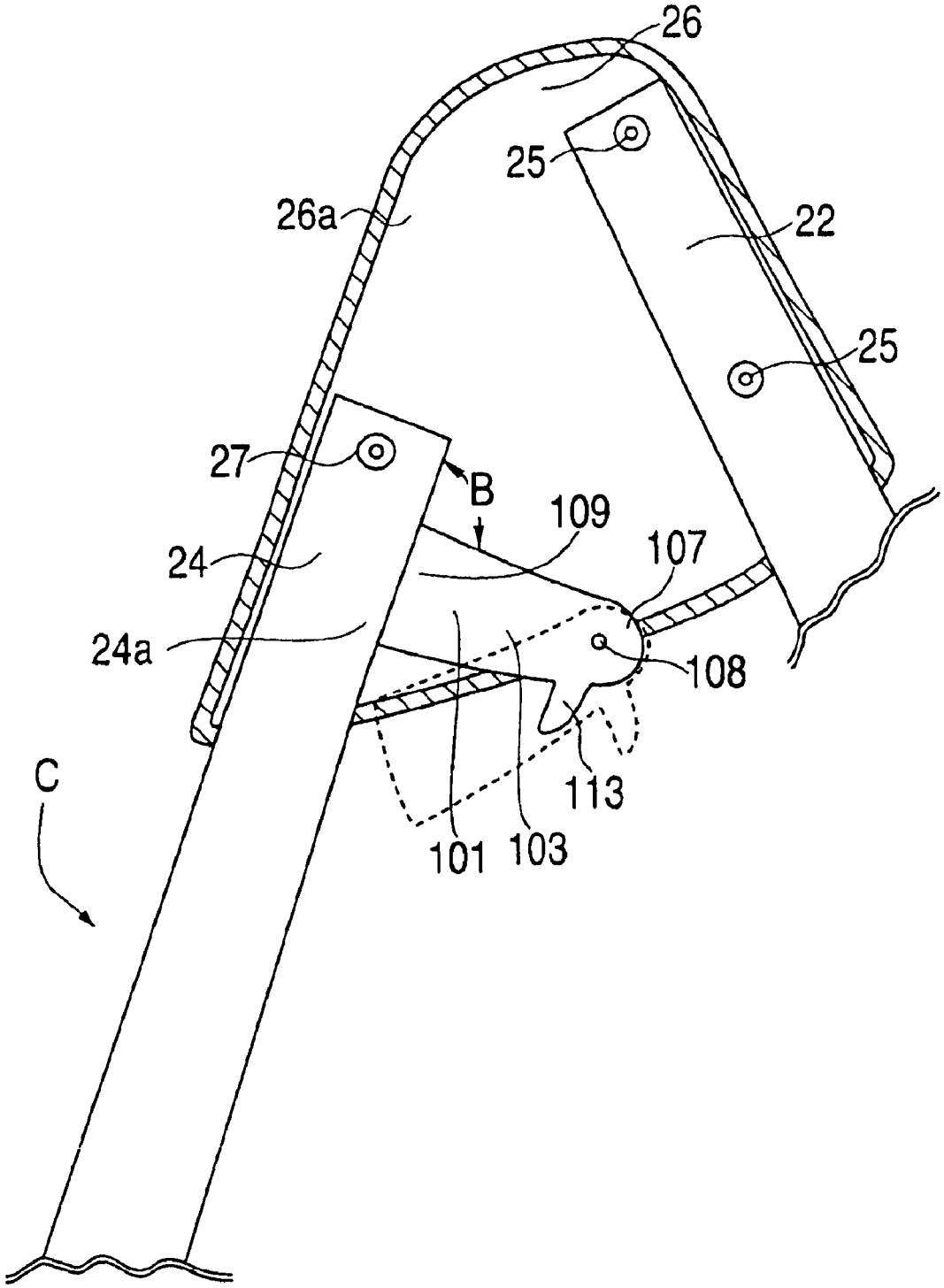
FIG. 7 is a partial sectional side view of an alternative embodiment of a latch mechanism according to the invention.

An alternative embodiment of a latch mechanism according to the invention is illustrated in FIG. 7. The latch mechanism is movable between an operative position and an unlocking position (illustrated in phantom in FIG. 7).

In the illustrated embodiment, locking mechanism 101 includes a body portion 103 having a first end 107 and a second end 109. As illustrated, first end 107 is rotatably coupled within the cavity 26*a* of housing 26 using any conventional fastener 108, such as a screw or rivet. Second end 109 has a surface shaped to engage the rear leg 24. The surface of second end 109 can be circular, flat, or any other shape that matches the contour or shape of the rear leg 24.

In the illustrated embodiment, a portion of the rear leg 24 forms an engagement portion 24*a* that is engaged by the second end 109 of locking mechanism 101 when the locking mechanism 101 is in the operative position. In this embodiment, the engagement portion 24*a* does not include any protrusion or recess formed on the rear leg 24.

In the operative or engaged position, the upper surface of body portion 103 forms an angle "B" with the outer surface of rear leg 24. In the illustrated embodiment, angle B is approximately 90°. In alternative embodiments, angle B may be less than 90°. For example, angle B may be 89°.

When the locking mechanism 101 engages the rear leg 24 and angle B is approximately 90° or less, the weight of the support structure creates a downward force that drives the engagement portion 24*a* of rear leg 24 into engagement with the locking mechanism 101.

As illustrated in FIG. 7, body portion 103 includes an extension or finger 113 disposed between first end 107 and second end 109. Extension 113 is configured to enable a user to engage extension 113 and rotate the latch 101 relative to housing 26. In order to move the frame 20 from the deployed position illustrated in FIG. 1, to the collapsed position illustrated in FIG. 2, the user engages extension 113 and rotates latch 101 downwardly along the direction of arrow "C" and out of engagement with leg 24 (to the position illustrated in phantom in FIG. 7). In order to rotate latch 101, the user may first have to release the force acting to engage leg 24 and latch 101 by pivoting leg 24 slightly outwardly from engagement with latch 101 in a direction opposite to arrow "C". When latch 101 disengages from rear leg 24, the rear leg 24 can pivot toward front leg 22 into the collapsed position in which rear leg 24 and front leg 22 are generally parallel as illustrated in FIG. 2.

An embodiment of a carriage assembly of a height adjustment mechanism is illustrated in FIGS. 3 and 4. In the illustrated embodiment, carriage assembly 200 includes a body portion 202 having an opening 204 formed therein for slidably receiving front leg 22.

Body portion 202 includes two openings (not shown) formed therein, the solid ends 203 of which are illustrated in FIGS. 3 and 4, for receiving mounting rods 50. As will be described in more detail below, mounting rods 50 are coupled to seat portion 30 so that seat portion 30 moves with carriage assembly 200 along front leg 22.

As illustrated in FIGS. 3 and 4, the carriage assembly 200 includes a coupler 210 with a first end 212 and a second end 214. A portion of first end 212 extends outwardly from body portion so that a user can selectively engage the first end 212 to pivot the coupler 210. Second end 214 is formed with a finger-like protrusion 216 which is configured to releasably engage an opening 22*a* in front leg 22.

Coupler 210 is pivotally coupled within body portion 202 using a conventional connector 218, such as a screw, rivet, etc. A biasing mechanism 220, such as a torsional spring, is coupled to latch mechanism 210 and disposed about connector 218. Biasing mechanism 220 engages body portion 202 to bias tab 216 into engagement with openings 22*a* of front leg 22, as illustrated in FIG. 3.

In order to lower the height of carriage assembly 200 and seat portion 30, a user engages and depresses first end 212 of latch mechanism 210 which causes tab 216 to rotate out of engagement with opening 22*a*, as illustrated in FIG. 4. Carriage assembly 200 can be moved along front leg 22 until tab 216 engages another opening 22*a* at the desired height of seat portion 30. Front leg 22 can include any number of openings 22*a* to provide for multiple height positions.

In order to raise the height of carriage assembly 200 and seat portion 30, a user may grasp and lift seat portion 30 which causes tab 216 to rotate and slide out of engagement with opening 22*a*. Alternatively, the user can engage and depress first end 212 as described above. Carriage assembly 200 can be moved along front leg 22 until tab 216 engages another opening 22*a* at the desired height of seat portion 30.

Figure 8:
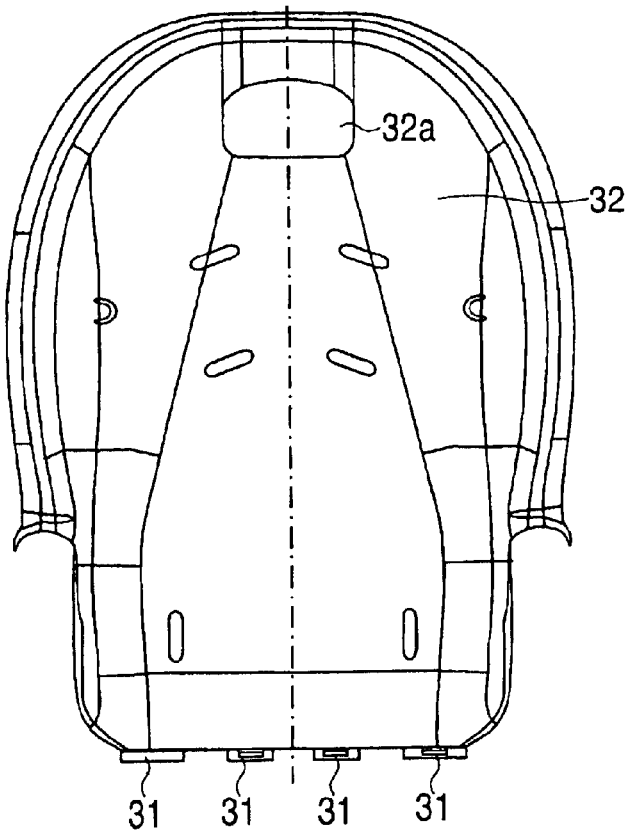
FIG. 8 is a front view of an embodiment of a seat back embodying the principles of the invention.
Figure 9:
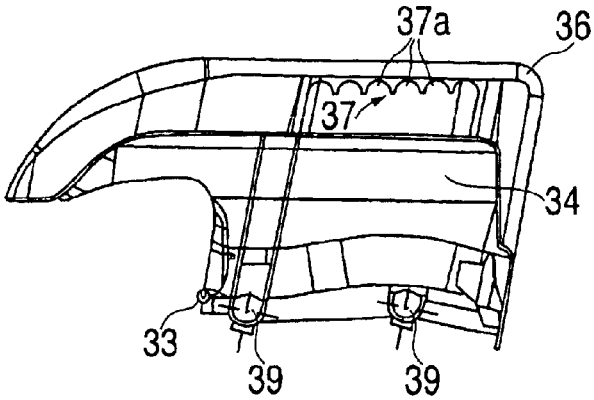
FIG. 9 is a side view of an embodiment of a seat bottom embodying the principles of the invention.
Figure 10:
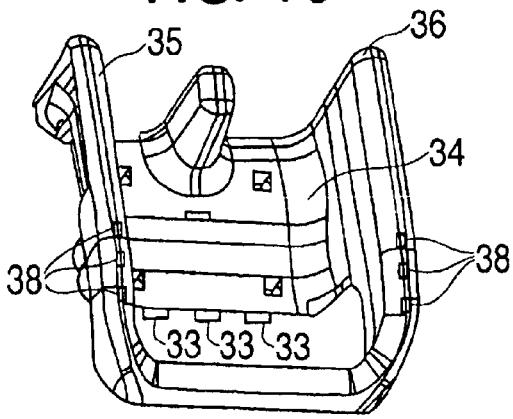
FIG. 10 is a perspective view of the seat bottom of FIG. 9.

An embodiment of a seat portion according to the invention is illustrated in FIGS. 8–10. The seat portion 30 includes a seat back 32 and a seat bottom 34. As illustrated in FIG. 8, seat back 32 includes a plurality of hinges 31 formed at a lower end of seat back 32. Hinges 31 are aligned with mating hinges 33 formed on a lower portion of seat bottom 34, as illustrated in FIG. 10. A rod (not shown) can be slid through each of the hinges 31 and 33 to connect seat back 32 and seat bottom 34 together. Seat back 32 also includes an opening 32*a* formed therein.

In the illustrated embodiment, seat bottom 34 includes several openings 39 through which mounting rods 50 are inserted. As illustrated in FIG. 9, seat bottom 34 also includes an engagement portion 37 formed on a side portion of arm portion 36. Engagement portion 37 includes a plurality of grooves 37*a*, which are configured to receive corresponding engagement portions on the tray 40, as described in further detail below.

As illustrated in FIG. 10, seat bottom 34 includes a pair of arm portions 35 and 36 extending upwardly from a lower portion of seat bottom 34. Several openings 38 are formed in arm portions 35 and 36. Openings 38 are used with the seat back recline assembly to retain the seat back 32 in a plurality of reclined positions relative to the seat bottom 34. Any number of openings 38 can be provided on arm portions 35 and 36.

Figure 13:
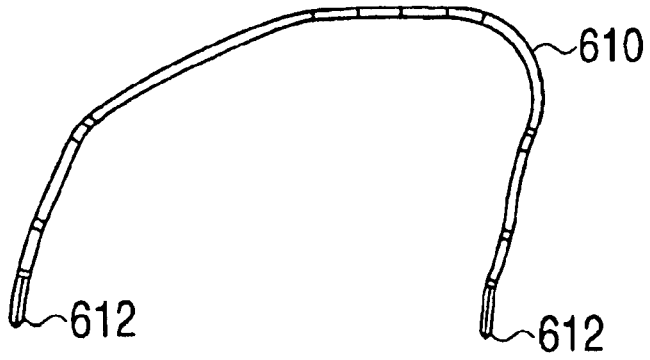
FIG. 13 is a detailed perspective view of an embodiment of a wire for the seat back recline assembly of FIG. 11 according to the principles of the invention.

An embodiment of a seat back recline assembly according to the invention is illustrated in FIGS. 11 through 14. In the illustrated embodiment, the recline assembly 600 includes a handle 602 slidably coupled to the rear surface of seat back 32. The handle 602 includes an outer surface 601 and an inner surface 603. A curved wire 610 is coupled to handle 602 and is configured to substantially conform to the contour of seat back 32. As illustrated in FIG. 13, wire 610 includes two end sections 612 that are configured to releasably engage openings 38 formed in the seat bottom 34.

Figure 14:
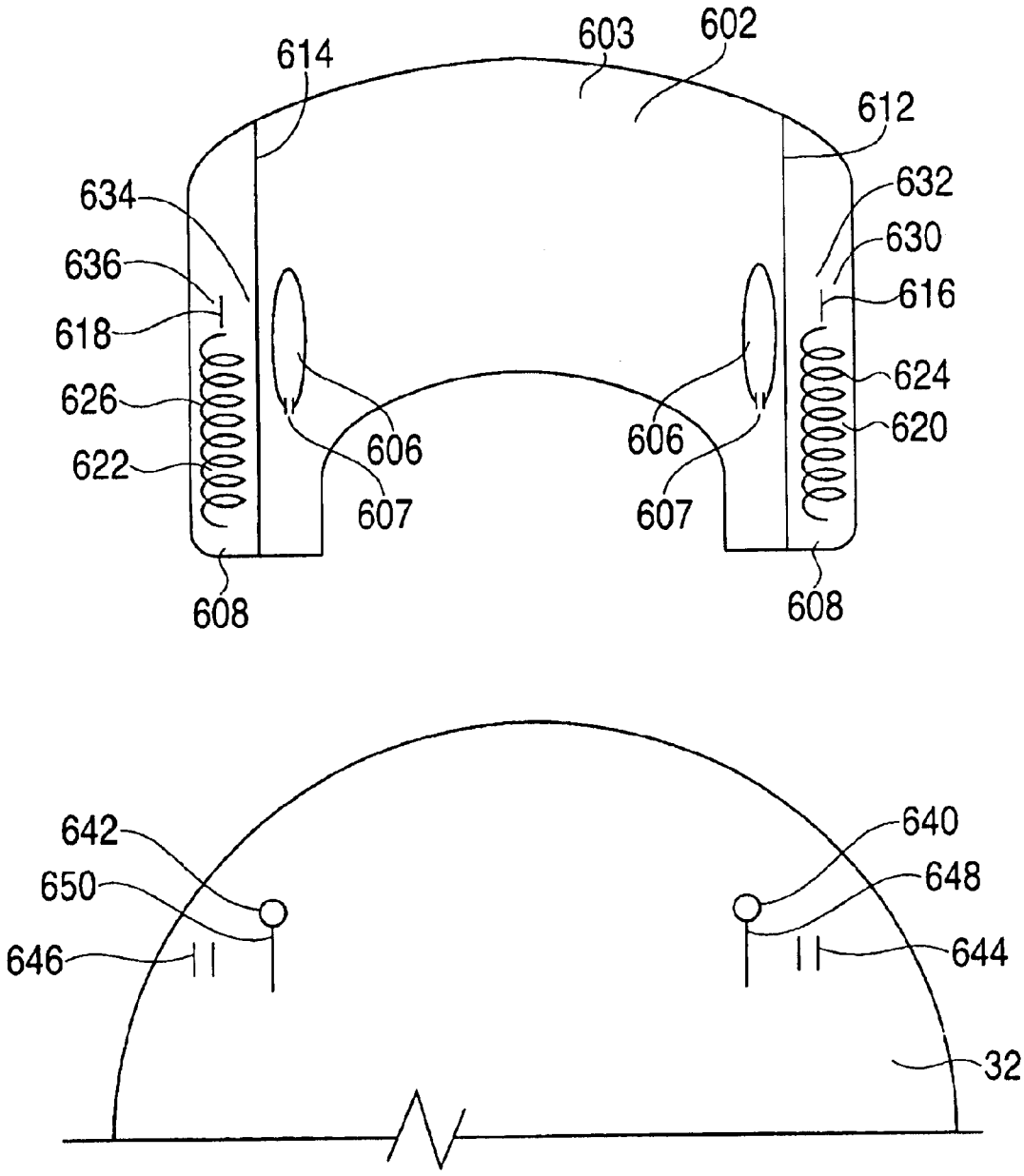
FIG. 14 is an exploded view of an embodiment of the connection between the seat back recline assembly and the seat back according to the principles of the invention.

Referring to FIG. 14, seat back 32 includes mounting posts 640 and 642 having guide portions 648 and 650, respectively, extending from the seat back 32. In addition, seat back 32 includes pairs of generally parallel guide rails 644 and 646. Handle 602 includes slots 606, each of which has an opening 607 formed at a lower end of slot 606. Mounting posts 640 and 642 engage slots 606 and guide portions 648 and 650 engage openings 607 to permit handle 602 to be moved between the positions illustrated in FIGS. 11 and 12.

In the illustrated embodiment, handle 602 includes an outer wall 608 and inner walls 612, 614. Inner walls 612, 614 and outer wall 608 define cavities 620 and 622, respectively. Two rails 616 and 618 are disposed within a portion of cavities 620 and 622, respectively. Rail 616, inner wall 612, and outer wall 608 define two passageways 630 and 632. Likewise, rail 618, inner wall 614, and outer wall 608 define two passageways 634 and 636. Guide rails 644 and 646 engage passageways 630, 632 and 634, 636, respectively, as handle 602 moves between the positions illustrated in FIGS. 11 and 12.

In the illustrated embodiment, a biasing mechanism 624, such as a spring, is disposed within cavity 620 between a lower end of rail 616 and outer wall 608. Another biasing mechanism 626 is disposed within cavity 622 between a lower end of rail 618 and outer wall 608. Biasing mechanisms 624 and 626 bias the handle 602 and the curved wire 610 in a downward orientation such that end sections 612 are biased into engagement with openings 38. When the handle 602 is released, springs 624 and 626 force rails 644 and 646 and outer wall 608 apart thereby biasing handle 602 downward. In order to move the seat back 32, the user lifts up on the handle 602 with sufficient force to overcome the springs 624 and 626.

Figure 11:
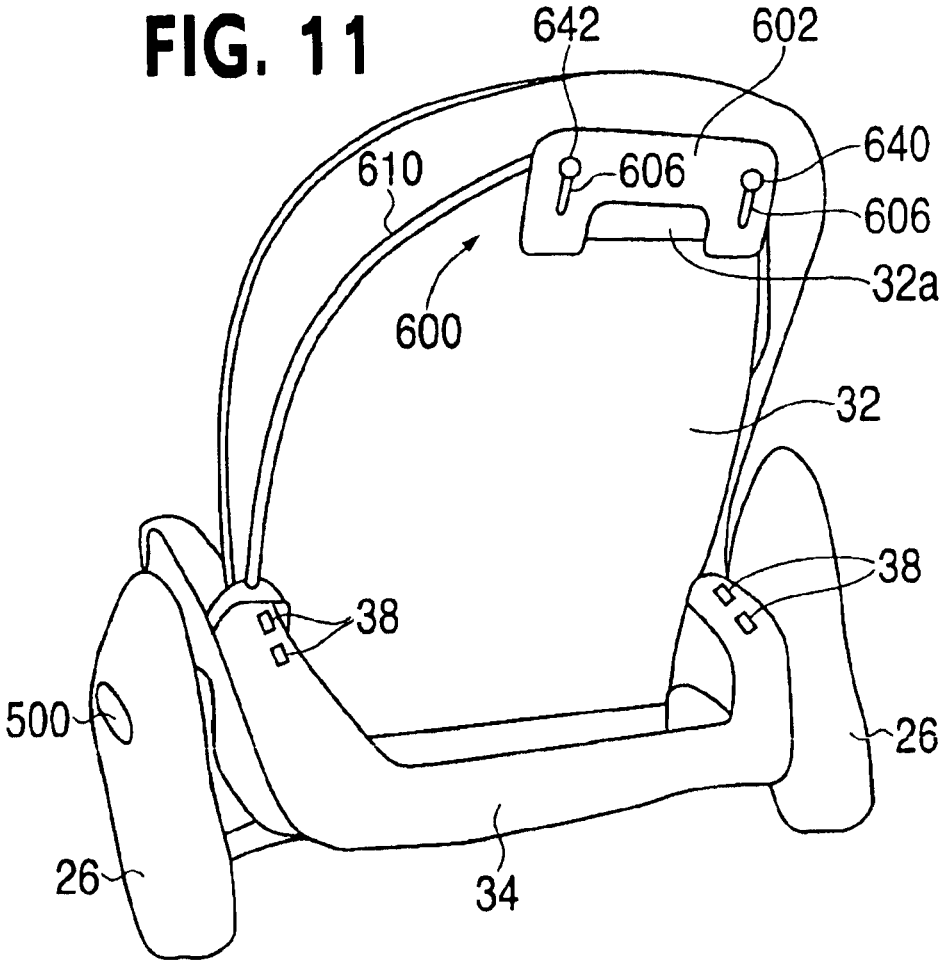
FIG. 11 is a perspective view of an embodiment of a seat back recline assembly in an engaged configuration according to the principles of the invention.
Figure 12:
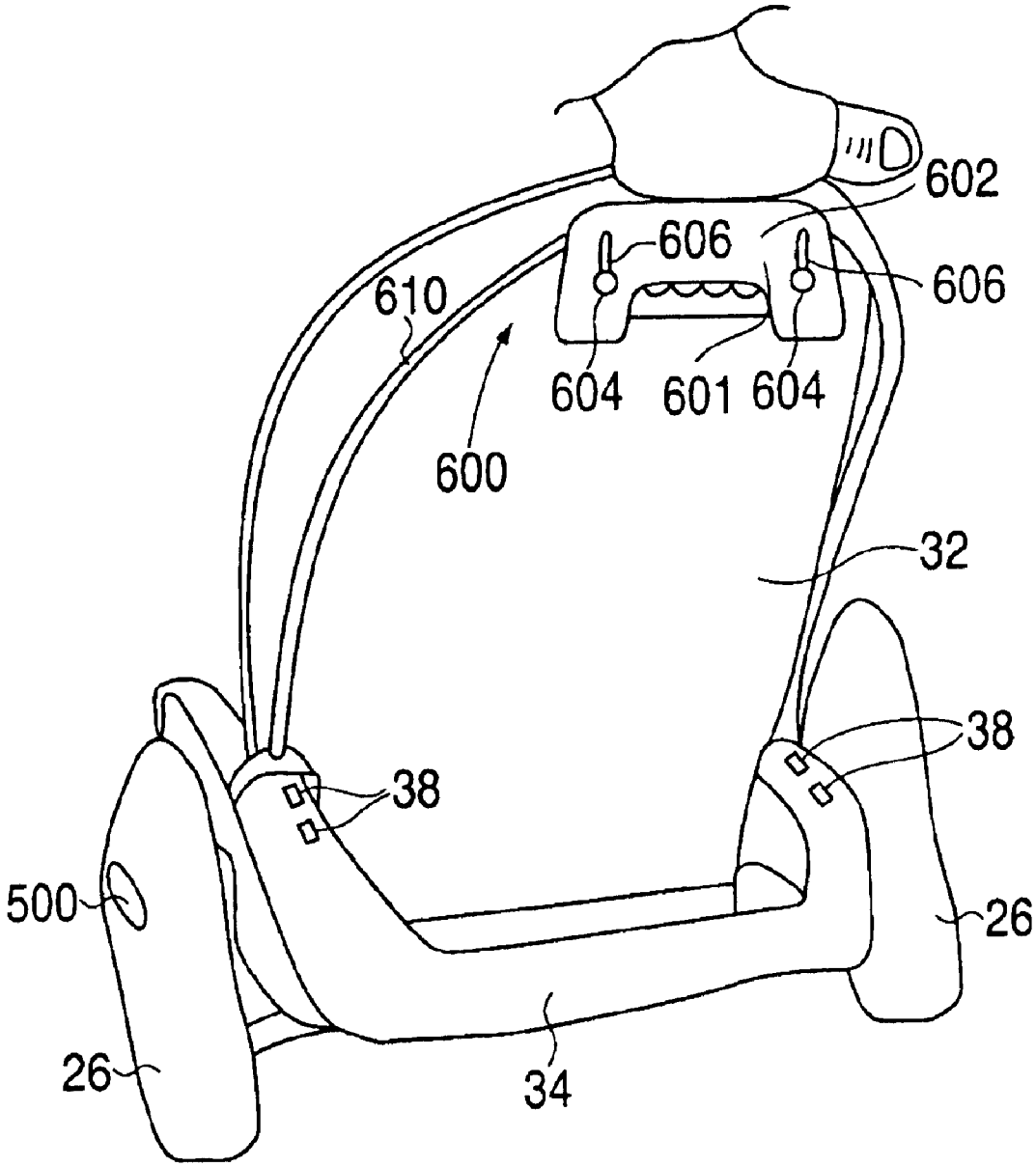
FIG. 12 is a perspective view of the embodiment of the seat back recline assembly of FIG. 11 in a disengaged configuration.

As illustrated in FIG. 11, latch assembly 600 includes a seat back 32 in a first position having end sections 612 of latch 610 engaged with the forward most openings 38. In order to change the recline angle of seat back 32 in relation to seat bottom 34, a user grasps handle 602 and pulls upwardly on handle 602 to move the end sections 612 out of openings 38. The user can then rotate the seat back 32 to the desired position and release the handle 602, thereby allowing end sections 612 to engage corresponding openings 38.

Figure 15:
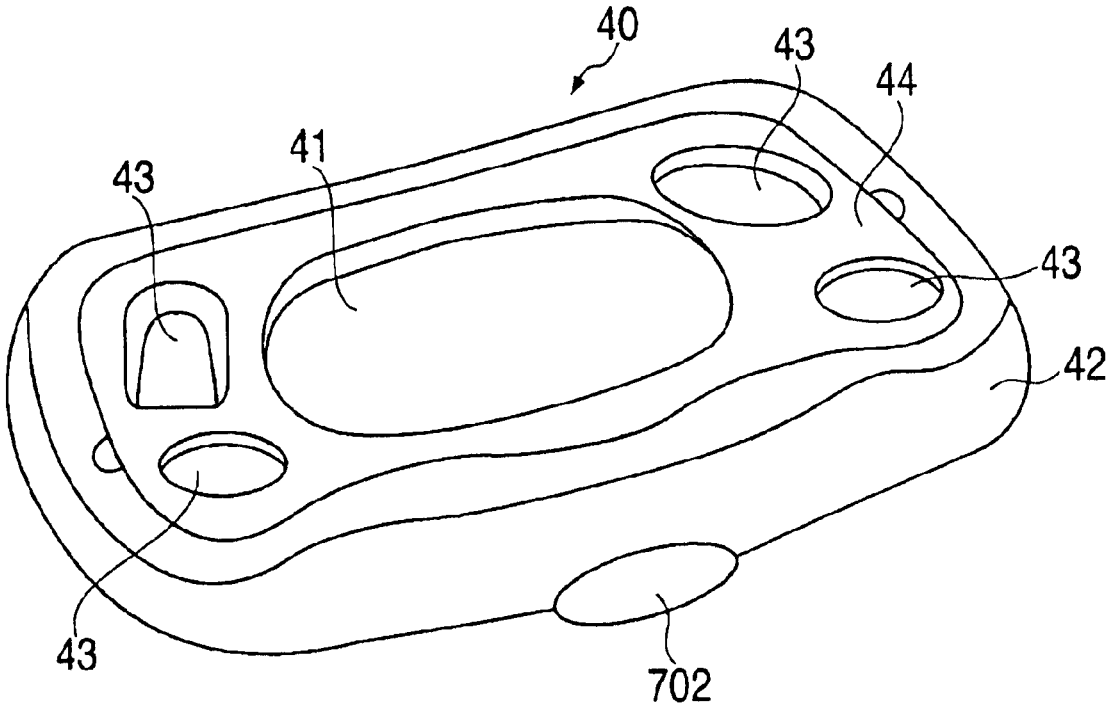
FIG. 15 is an assembled perspective view of an embodiment of a tray set according to the principles of the invention.

A tray set according to an embodiment of the invention is illustrated in FIG. 15. In one embodiment, the tray insert 44 includes a central large pocket or cavity 41 and several smaller pockets or cavities 43. The sizes and number of cavities 41 and 43 can vary depending on the desired configuration of the tray insert 44. Tray insert 44 is releasably coupleable to base tray 42.

Figure 16:
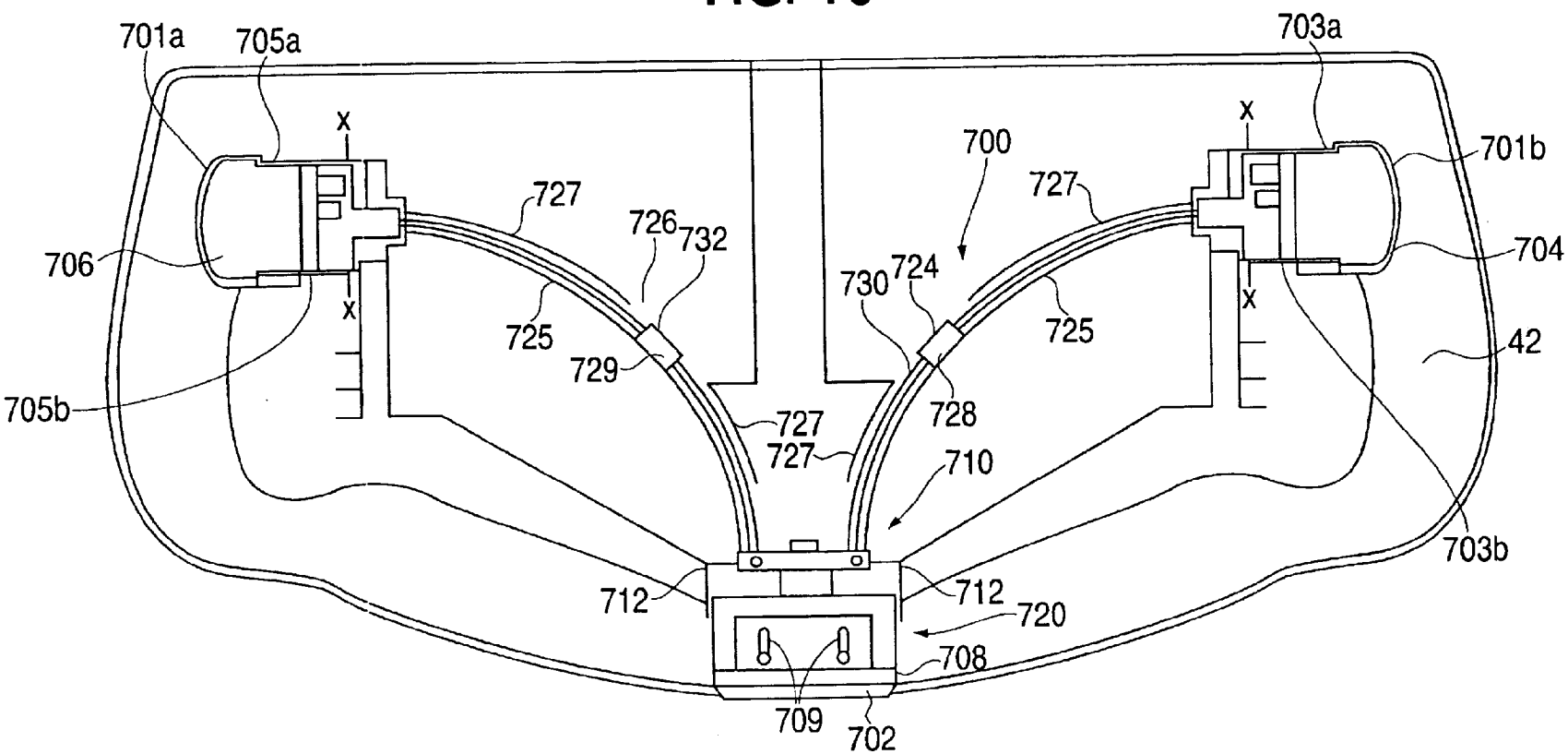
FIG. 16 is a bottom view of an embodiment of a tray securing assembly according to the principles of the invention.

As illustrated in FIG. 16, base tray 42 includes a tray securing assembly 700 coupled to the bottom surface of the base tray 42. The tray securing assembly 700 enables the base tray 42 to be secured to and released from the arm portions 35 and 36 of the seat portion 30.

In the illustrated embodiment, securing assembly 700 includes right and left connection members 704 and 706 coupled to the bottom surface of the base tray 42. Connection members 704 and 706 are used to releasably couple the base tray 42 to the arm portions 35 and 36 of seat portion 30. As illustrated in FIG. 16, the bottom surface of tray 42 includes cavities 701*a*, 701*b* defined by side walls 705*a*, 705*b* and 703*a*, 703*b*, respectively. Each connection member 704 and 706 is disposable in an opened position and a closed position and pivot about an axis X—X (see FIG. 16). A biasing mechanism (not shown) is disposed between each of connection members 704 and 706 and the lower surface of tray 42. The biasing mechanisms biases the connection members 704 and 706 into their closed positions, i.e., into engagement with base tray 42. In an alternative embodiment, connection members 704 and 706 can be slidable between the open and closed positions.

In the illustrated embodiment, a housing 710 extends from the bottom surface of the base tray 42. Housing 710 is configured to receive an interconnection member 720. In particular, housing 710 includes two rails 712 coupled to the bottom surface of the tray 42, and defining a recess or cavity therebetween.

As shown in the illustrated embodiment, a pair of guide slots 724 and 726 extend along the bottom surface of tray 42 and from the housing 710 to each of the cavities 701*a* and 701*b*. As illustrated in FIG. 16, each guide slot includes an inner extension 725, an outer extension 727, and a track stay 728 or 729.

Interconnection member 720 includes button 702 and a body portion 708 with a pair of guide slots 709 via which it is coupled to the tray 42. A pair of connectors are inserted in slots 709 to retain body portion 708 for movement between open and closed positions.

Figure 18A:
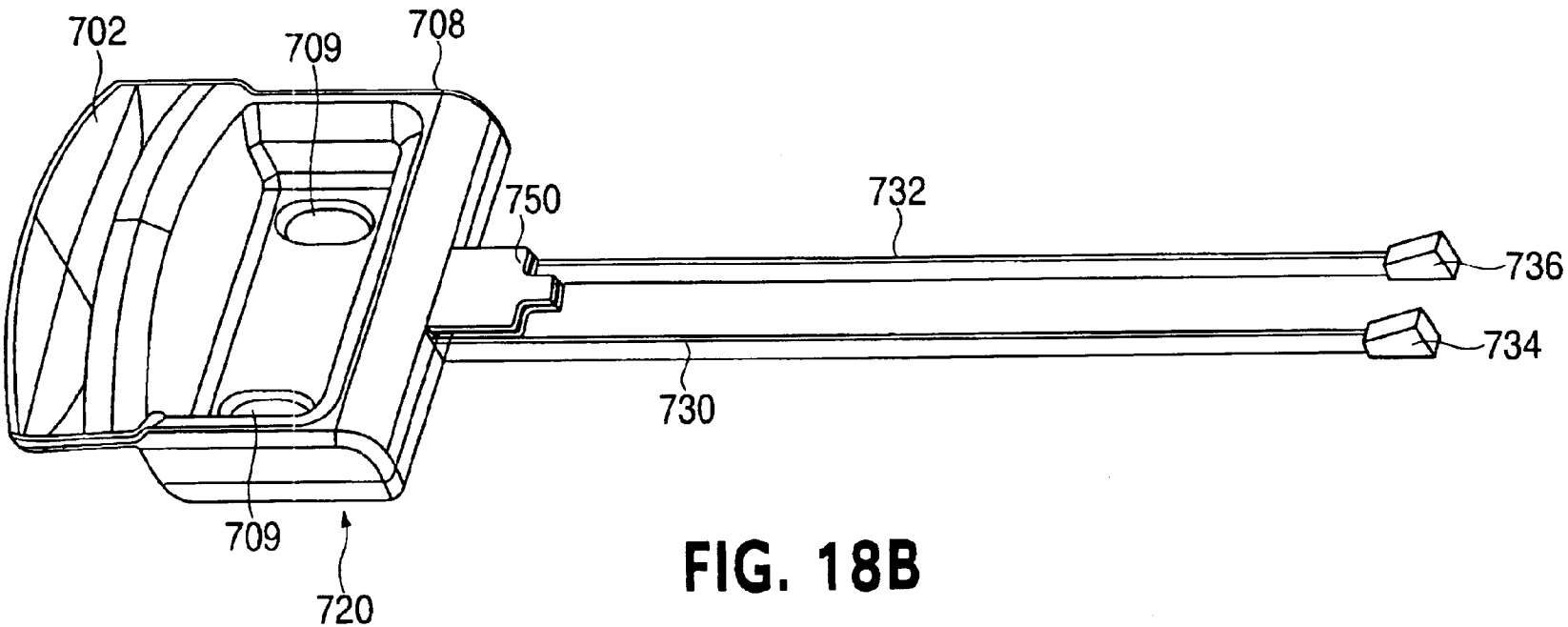
FIG. 18A is a perspective view of an embodiment of a flexible interconnection member according to the principles of the invention.
Figure 18B:
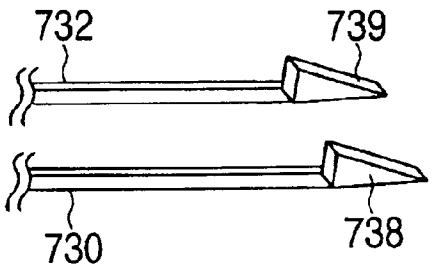
FIG. 18B is a partial perspective view of an alternative embodiment of a flexible interconnection member according to the principles of the invention.

As illustrated in FIGS. 16 and 18A, the securing mechanism includes flexible connection straps 730 and 732. The straps 730 and 732 are coupled to the body portion 708 and to connection members 704 and 706 along guide slots 724 and 726. Each strap 730 and 732 includes a generally tapered tab 734 and 736, respectively. Alternative embodiments of the generally tapered tabs 738 and 739 are illustrated in FIG. 18B. The straps may be integrally formed with body portion 708 or may be separately coupled to body portion 708.

Figure 17:
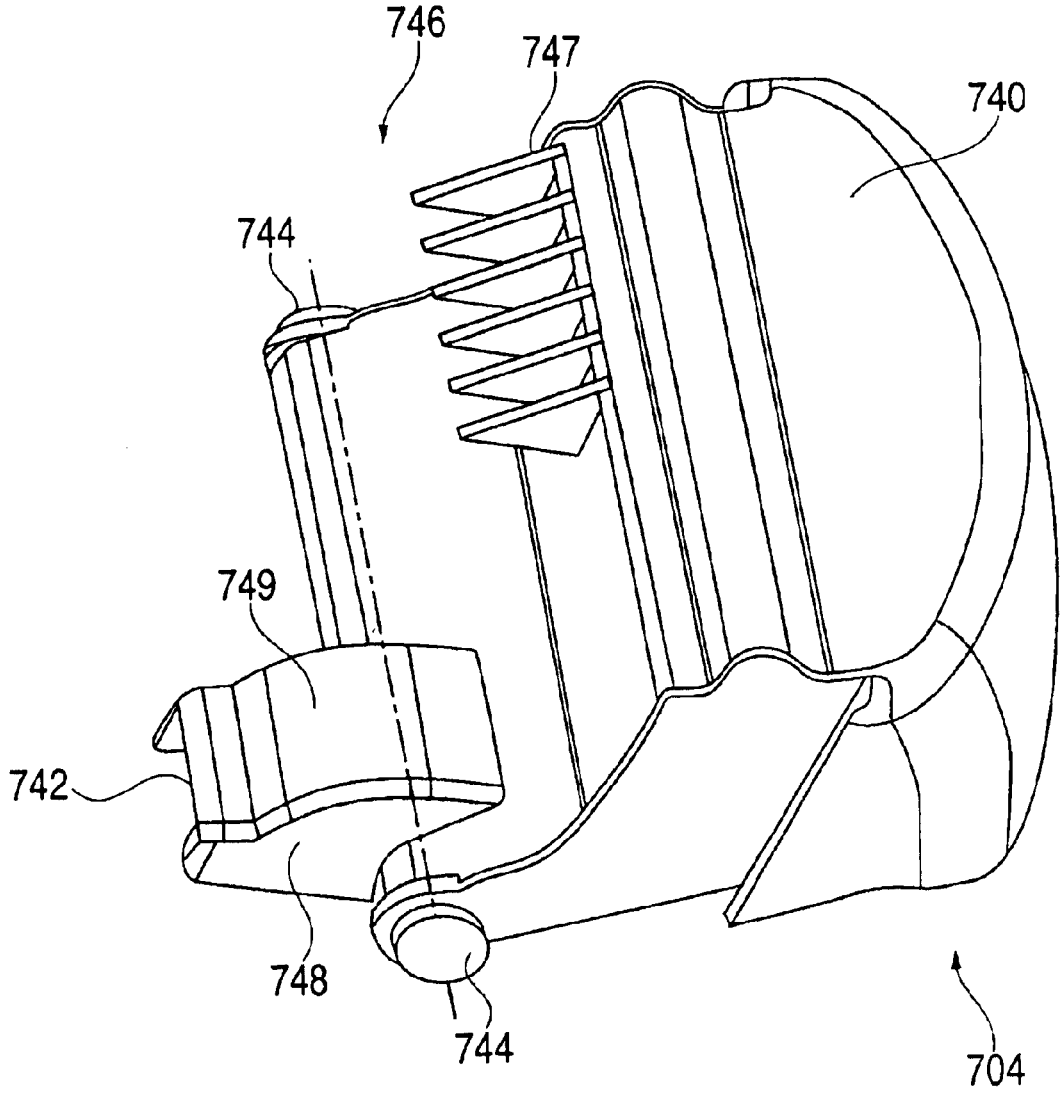
FIG. 17 is a perspective view of an embodiment of a connection member according to the principles of the invention.

An embodiment of connection member is illustrated in FIG. 17. In the illustrated embodiment, connection member 704 includes a hand-receiving portion 740. The connection member 703 includes posts 744 on each side. The posts 744 are coupled to the side walls 703*a* and 703*b*. Although not illustrated, connection member 706 includes posts 744 that are coupled to side walls 705*a* and 705*b*.

In the illustrated embodiment, a housing 748 extends outwardly from a lower portion of an inner surface of the connection member 704. Housing 748 is configured to receive an end of one of the connection straps 730. As illustrated in FIG. 17, housing 748 includes a tapered upper surface 749 having a leading edge 742. Each of the tapered upper surface 749 and leading edge 742 is adapted to engage the tapered tab 734 on the strap 730. The relative movement of housing 748 and tab 734 causes the connection member 704 to pivot between an open and closed position.

A connection portion 746 adapted to engage with the support structure 10 to releasably couple the base tray 42 to the support structure 10 is illustrated in FIG. 17. In the illustrated embodiment, connection portion 746 is adapted to engage grooves 37*a* of engagement portion 37 of arm portions 35 and 36 when the connection member 704 is in the closed position. As illustrated in FIG. 17, connection portion 746 includes two tabs 747 having a plurality of rib sections extending from the upper surface of connection portion 746. The lower portion or engagement portion of tabs 747 is formed in a generally circular configuration such that tabs 747 cooperate and mate with the generally circular grooves 37*a* of arm portions 35 and 36 to secure the tray 42 to the arm portions 35 and 36.

In the illustrated embodiment, the connection members 704 and 706 can be moved to their open positions when the user pulls the actuator 702 outwardly from the tray 42. During an outward movement of the actuator 702, the connection straps 730 and 732 slide along their respective guide slots 724 and 726 away from connection members 704 and 706. As a result, the angular tabs 734 and 736 slide within the housings 748 and the upper surface 749 slides along tabs 734 and 736, thereby causing the connection members 704 and 706 to pivot about the posts 744. Once the actuator 702 is released by the user, the connection members 704 and 706 are biased back to their closed positions. When the connection members 704 and 706 are in their open positions, the tray 42 can be removed from the support structure 10.

In an alternative embodiment, the connection members 704 and 706 can be moved to their open positions when the user pushes the actuator 702 inwardly. During inward movement of the actuator 702, the connection straps 730 and 732 slide along their respective guide slots 724 and 726 toward the connection members 704 and 706. As a result, the angular tabs 738 and 739 slide under and engage the leading edge 742, thereby causing the connection members 704 and 706 to pivot about the posts 744. Once the actuator 702 is released by the user, the connection members 704 and 706 are biased back to their closed positions. When the connection members 704 and 706 are in their open positions, the tray 42 can be removed from the support structure 10.

In the illustrated embodiment, the connection members 704 and 706 can be independently moved to their open positions by the operation of the corresponding connection members 704 and 706. For example, a user may grasp and depress the hand-receiving portion 740 toward the lower surface of base tray 42. As a result, the connection members 746 pivot away from the lower surface of the base tray 42 into their open position. Once the hand-receiving portion 740 is released by the user, the biasing mechanism causes the connection member 704 to pivot back into its closed position.

Figure 19:
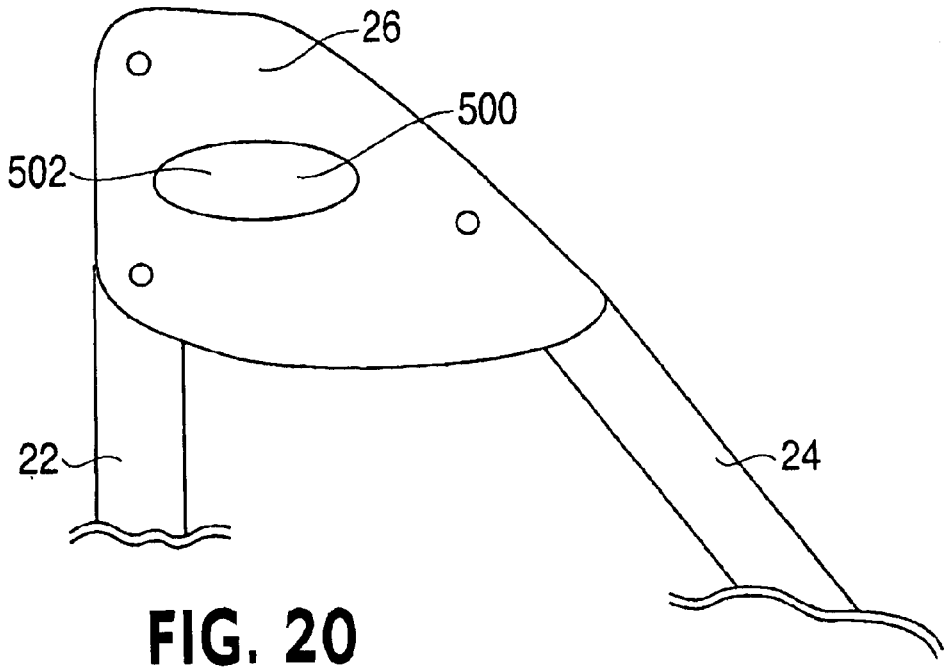
FIG. 19 is a side view of an embodiment of a housing and a coupler according to the principles of the invention.
Figure 20:
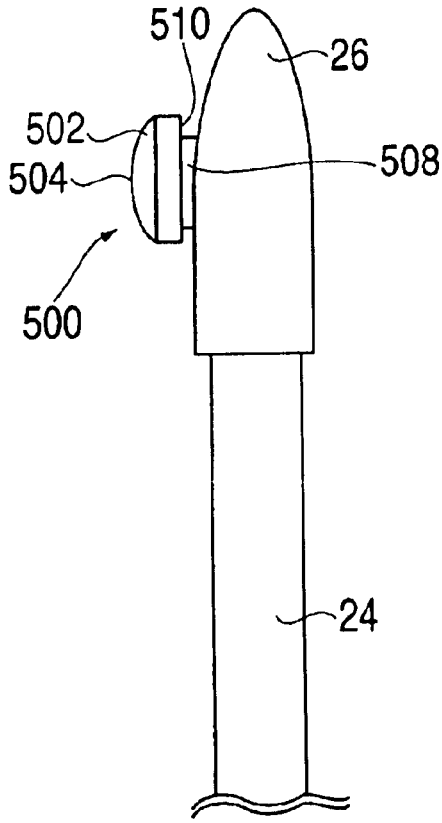
FIG. 20 is a front elevational view of the coupler of FIG. 19.

An embodiment of a housing of a child support structure according to the present invention is illustrated in FIGS. 19 and 20. In the illustrated embodiment, the housing 26 includes a coupling member coupler 500 coupled to an outer surface of housing 26. Coupler 500 can be coupled to housing 26 using any conventional fasteners. Alternatively, coupler 500 can be formed integrally with housing 26.

In the illustrated embodiment, coupler 500 includes a generally elliptical body portion 502 having a curved outer surface 504. Body portion 502 includes a stem portion 508 that is coupled to housing 26. Since the stem portion 508 is smaller than the remainder of body portion 502, a ridge 510 is formed on the coupler 500. Coupler 500 may have any shape that enables a container to be coupled to the housing 26.

Figure 21:
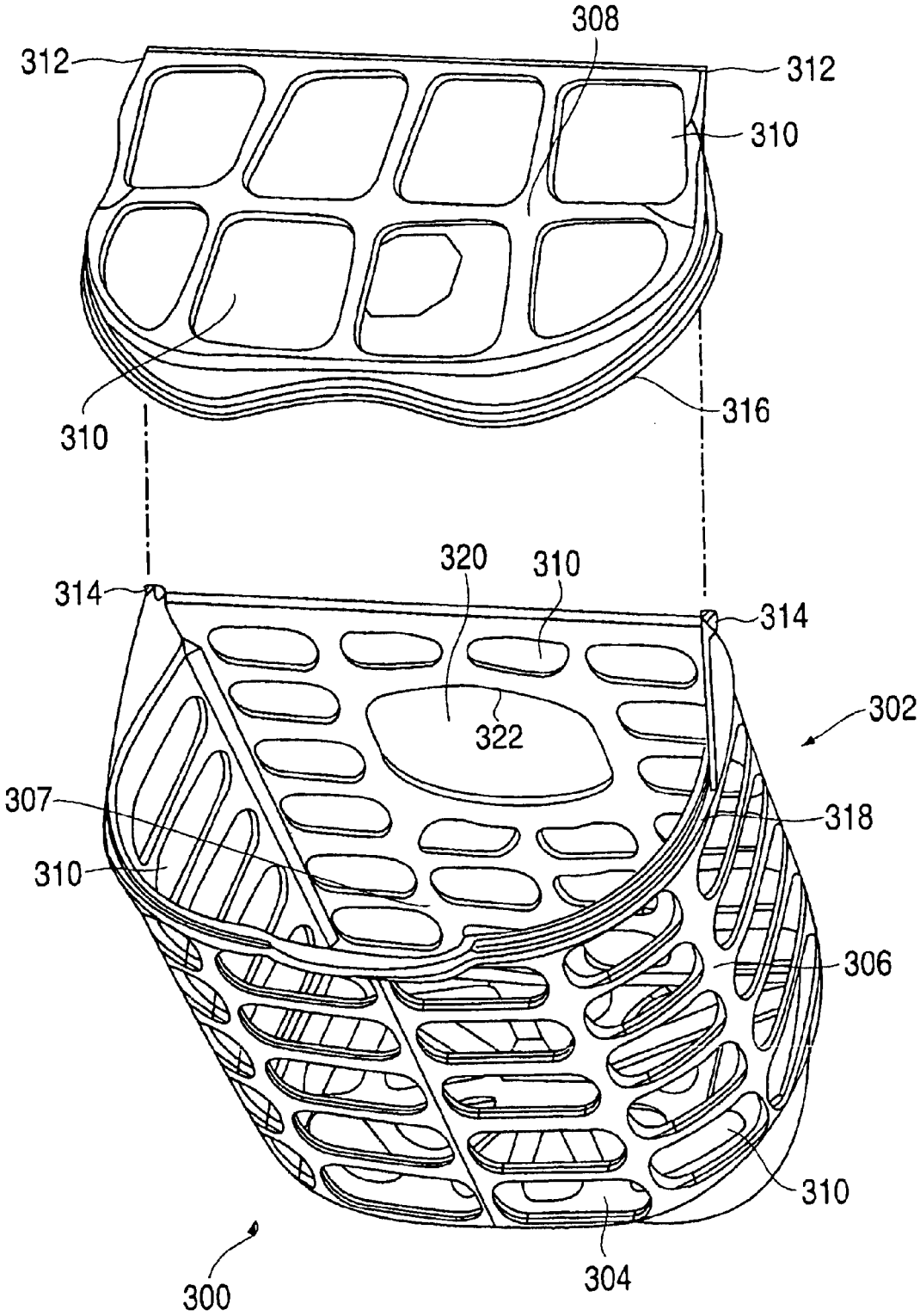
FIG. 21 is an exploded perspective view of an embodiment of a container according to the principles of the invention.

An embodiment of a container or basket according the invention is illustrated in FIG. 21. Basket 300 includes a body portion 302 having a bottom wall 304, a side wall 306, and a top wall 308. Side wall 306 may be a single wall or may include several walls. Each of the walls may be referred to as a portion. Body portion 302 can be referred to alternatively as a support portion or a receiving portion.

The bottom wall 304, side wall 306, and top wall 308 define an interior region 307 for holding articles, such as baby bottles, feeding utensils, toys, etc. The bottom wall 304, side wall 306, and top wall 308 include at least one opening or perforation 310. As illustrated in FIG. 21, each of the bottom, side, and top walls include a plurality of perforations 310. Perforations 310 enable a user to observe articles within the interior region of the basket 300. The perforations 310 also allow water or any other cleaning liquids to enter and flow through the basket 300 to clean articles contained therein.

As illustrated in FIG. 21, the top wall 308 includes two mounting tabs 312 which engage corresponding apertures 314 formed in an upper portion of the side walls 306 to rotatably couple top wall 308 to side wall 306. In addition, top wall 308 includes a front rim 316 that is configured to releasably engage a rim 318 located around an upper perimeter of side wall 306. Front rim 316 engages rim 318 in a conventional snap fit arrangement. However, other releasable fits or engagements can be used to secure the top wall to the rest of the basket.

In the illustrated embodiment, a mounting opening or aperture 320 is formed in a portion of side wall 306. Aperture 320 is configured to receive a portion of the coupler 500 on housing 26. The surface 322 defining aperture 320 engages ridge 510 when the basket 300 is coupled to the housing 26. While aperture 320 has substantially the same configuration as the coupler 500 on the housing 26, the aperture may have any shape that enables the container to be supported on the housing 26.

Alternatively, body portion 302 includes a receiving portion, such as a cavity or recess that does not pass completely through body portion 320. The receiving portion is configured to receive a portion of the coupler 500. The receiving portion and the coupler may have any configurations that enable the body portion 302 to be coupled to the housing 26. For example, the receiving portion and the coupler may have mating configurations, such as dovetail configurations. In alternative embodiments, a coupler 500 can be disposed on body portion 302 and a receiving portion or aperture can be formed on housing 26.

Figure 22:
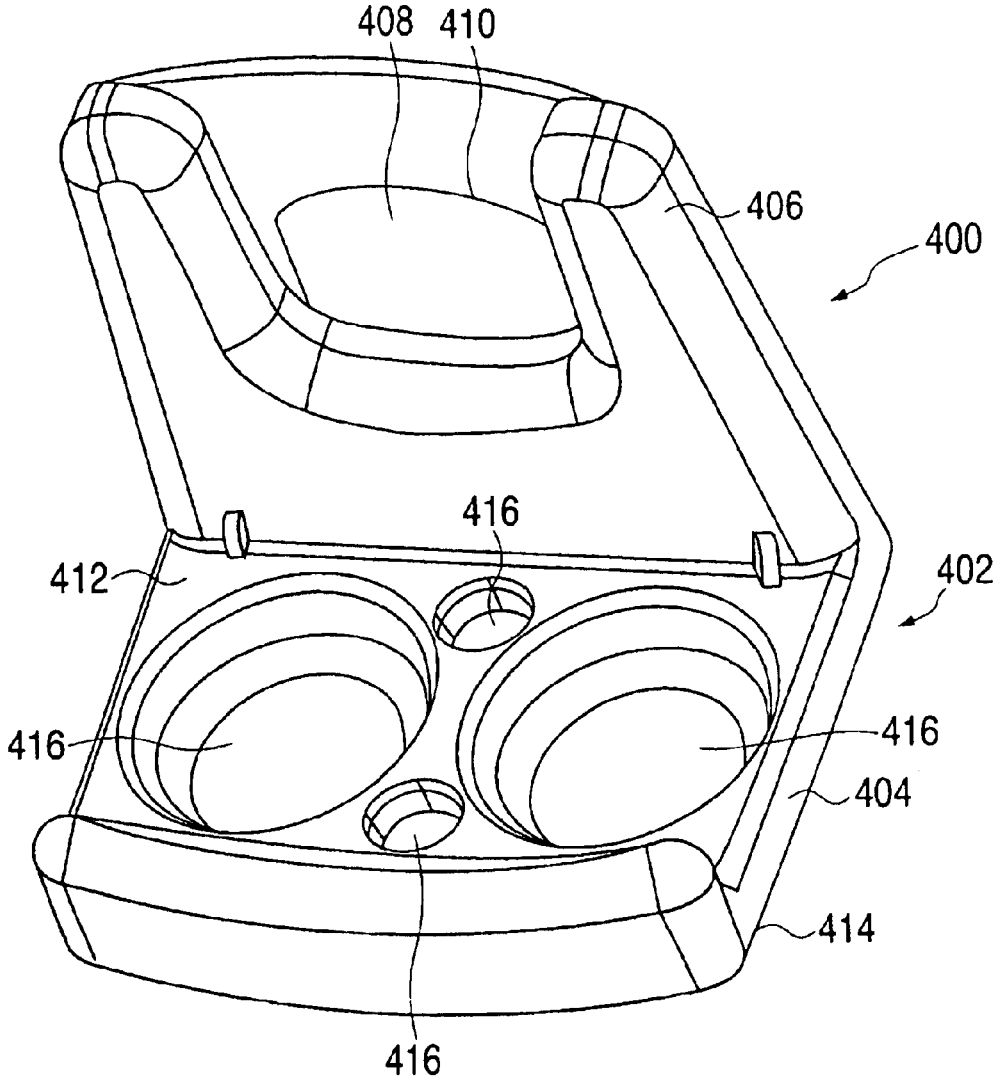
FIG. 22 is a perspective view of an alternative embodiment of a container according to the principles of the invention.

An alternative container according to an embodiment of the invention is illustrated in FIG. 22. In the illustrated embodiment, container 400 includes a support surface or portion 404 and a mounting portion 406 extending upwardly from the support surface 404. Mounting portion 406 includes a mounting aperture 408. In the illustrated embodiment, the mounting aperture 408 is centrally located in the mounting portion. Mounting aperture 408 is configured to releasably engage the coupler 500 on housing 26. In particular, surface 410 of mounting portion 406 engages ridge 510 of coupler 500 when the container 400 is coupled to the housing 26.

As illustrated in FIG. 22, support surface 404 includes an upper region 412 and several cavities 416 formed in the upper region 412. The size and quantities of the cavities 416 can vary. Cavities 416 are configured to releasably secure articles such as cups, bowls, and the like, to the container 400. When the container 400 is coupled to the support structure 10, container 400 holds feeding utensils and other items next to the child support structure 10. The container 400 and its contents can be removed from the coupler 500 of housing 26 and the container 400 and contents can be easily cleaned.

Unless otherwise indicated herein, it is to be understood that the component parts of the invention are preferably made from materials which can be molded and which are sufficiently durable and safe for use with infants and children of any age. Exemplary materials include plastic, stainless steel, and aluminum.

Although the exemplary embodiments have been illustrated as embodied on a child support structure, various other configurations are possible and may include other structures, such as wheel chairs, swings, and the like.

In an alternative embodiment, the basket 300 and container 400 may include a mounting coupler that engages a recess formed in a housing on the support structure.

The quantity of baskets and containers may vary, depending on the desired arrangement for the support structure.

Alternatively, the mounting apertures on the containers do not need to extend through a wall or other portion of the container and may have any shape or configuration.

While the invention has been described in detail and with reference to specific embodiments thereof, it will be apparent to one skilled in the art that various changes and modifications can be made therein without departing from the spirit and scope thereof. Thus, it is intended that the present invention covers the modifications and variations of this invention provided they come within the scope of the appended claims and their equivalents.

What is claimed is:

1. A support structure comprising:

a frame having a front leg and a rear leg, each of said front leg and said rear leg having an upper end;

a seat coupled to said frame;

a tray coupled to said seat;

a housing coupled to said upper ends of said front leg and said rear leg, said housing including an outer surface;

a coupling member disposed on said outer surface of said housing; and a container configured to be removably coupled to said coupling member, the container defining an upwardly open cavity configured to receive an article therein.

2. The support structure of claim 1, wherein said container includes a body portion, said body portion defining a recess adapted to receive said coupling member.

3. The support structure of claim 2, wherein said coupling member includes a ridge formed about a perimeter of said coupling member.

4. The support structure of claim 2, wherein said body portion includes a bottom wall and a plurality of side walls, each of said bottom wall and said side walls defining perforations therein.

5. The support structure of claim 4, wherein said body portion includes a top wall defining perforations therein, said top wall being coupled to at least one of said side walls.

6. The support structure of claim 2, wherein said body portion includes a support surface having the upwardly open cavity formed therein.

7. The support structure of claim 1, wherein said front leg is pivotally mounted to said housing.

8. The support structure of claim 1, further comprising:

a second housing, said frame further having a second front leg and a second rear leg, said second housing coupling said second leg to said first leg; and a second coupling member disposed on an outer surface of said second housing.

9. The support structure of claim 8, further comprising a second container, said second container having a different configuration from said first container and configured to attach to one of said first coupling member and said second coupling member.

10. A child support structure comprising:

a frame assembly, said frame assembly having a first front leg portion, a second front leg portion, a first rear leg portion and a second rear leg portion;

a first housing coupling said first front leg portion to said first rear leg portion;

a second housing coupling said second front leg portion to said second rear leg portion;

a first connection member disposed on said first housing;

a second connection member disposed on said second housing; and a container, said container being configured to be removably coupled to one of said first connection member and said second connection member to realeasably couple said container to only one of said first housing and said second housing, the container defining an upwardly open cavity configured to receive an article therein.

11. The child support structure of claim 10, wherein said container includes a bottom portion having at least one opening, a side portion having at least one opening, a top portion having at least one opening and releasably coupled to said side portion, and a mounting aperture formed in said side portion and configured to receive one of said first connection member and said second connection member.

12. The child support structure of claim 11, wherein said top portion is pivotally hinged to said side portion.

13. The child support structure of claim 11, wherein said container is a first container, the child support structure further comprising a second container, said second container being configured to be releasably coupled to one of said first housing and said second housing.

14. The child support structure of claim 13, wherein said second container is substantially L-shaped.

15. The child support structure of claim 11, wherein said first front leg is pivotally coupled to said first housing, and said second front leg is pivotally coupled to said second housing.

16. A child support structure comprising:

a frame assembly, said frame assembly having a first front leg portion, a second front leg portion, a first rear leg portion and a second rear leg portion;

a first housing coupling said first front leg portion to said first rear leg portion;

a second housing coupling said second front leg portion to said second rear leg portion;

a first connection member disposed on said first housing;

a second connection member disposed on said second housing; and a container, said container being configured to be coupled to one of said first connection member and said second connection member to realeasably couple said container to only one of said first housing and said second housing, said container including a bottom portion having at least one opening, a side portion having at least one opening, a top portion having at least one opening and being pivotally hinged and releasably coupled to said side portion, and a mounting aperture formed in said side portion and configured to receive one of said first connection member and said second connection member.

17. A child support structure comprising:

a frame assembly, said frame assembly having a first front leg portion, a second front leg portion, a first rear leg portion and a second rear leg portion;

a first housing coupling said first front leg portion to said first rear leg portion;

a second housing coupling said second front leg portion to said second rear leg portion;

a first connection member disposed on said first housing;

a second connection member disposed on said second housing;

a first container, said container being configured to be coupled to one of said first connection member and said second connection member to realeasably couple said container to only one of said first housing and said second housing, said container including a bottom portion having at least one opening, a side portion having at least one opening, a top portion having at least one opening and releasably coupled to said side portion, and a mounting aperture formed in said side portion and configured to receive the one of said first connection member and said second connection member; and a second container, said second container being L-shaped and configured to be releasably coupled to the other one of said first housing and said second housing.

* * * * *